US005259179A

United States Patent [19]

Sekiya et al.

[11] Patent Number: 5,259,179

[45] Date of Patent: Nov. 9, 1993

[54] DEVICE FOR STOPPING BOBBIN RAIL OF FLYER FRAME AT A DESIRED POSITION

[75] Inventors: Shigeki Sekiya, Kuwana; Takashi Kogiso, Mizunami; Yoshio Kurachi, Nishikasugai, all of Japan

[73] Assignee: Howa Machinery, Ltd., Japan

[21] Appl. No.: 845,174

[22] Filed: Mar. 3, 1992

[30] Foreign Application Priority Data

Mar. 11, 1991 [JP] Japan ..... 3-072496

[51] Int. Cl.[5] ..... D01H 1/04

[52] U.S. Cl. ..... 57/264; 57/71; 57/276; 57/98; 242/26.3

[58] Field of Search ..... 57/71, 264, 276, 277, 57/95, 98, 99; 242/18 EW, 26.1, 26.2, 26.3

[56] References Cited

U.S. PATENT DOCUMENTS

| | | | |
|---|---|---|---|
| 3,287,891 | 11/1966 | Pfeifer | 57/98 X |
| 3,316,700 | 5/1967 | Mason et al. | 57/98 |
| 3,751,898 | 8/1973 | Inaba et al. | 242/18 EW X |
| 4,122,654 | 10/1978 | Oswald . | |
| 4,138,072 | 2/1979 | Aoyama et al. | 242/18 EW X |
| 4,384,689 | 5/1983 | Bloomfield et al. | 242/18 EW X |
| 4,467,592 | 8/1984 | Araki | 57/264 X |
| 5,117,621 | 6/1992 | Feichtinger et al. | 57/276 X |

FOREIGN PATENT DOCUMENTS

| | | | |
|---|---|---|---|
| 0321404 | 6/1989 | European Pat. Off. . | |
| 0386519 | 9/1990 | European Pat. Off. . | |
| 62-53425 | 3/1987 | Japan . | |
| 62-90328 | 4/1987 | Japan . | |
| 64-52828 | 2/1989 | Japan . | |
| 250423 | 10/1989 | Japan | 57/277 |
| 1250423 | 10/1989 | Japan . | |
| 3-33230 | 2/1991 | Japan . | |

*Primary Examiner*—Joseph J. Hail, III

*Attorney, Agent, or Firm*—Stevens, Davis, Miller & Mosher

[57] ABSTRACT

When a full bobbin signal from a counter CCM counting the number of rotations of the front roller (3) is output, the control element (28) outputs a signal directed to the control motor (M2) of a unit (29) for reciprocating a bobbin rail (10). As a result, the rotation of the control motor (M2) is combined with the rotation of a differential gear (14 ) connected to the main motor (M1), so that a reciprocating movement of the bobbin rail (10) after the full bobbin state is obtained which is faster than that obtained during a usual taking up operation of the roving, which causes the roving to be wound on the bobbin in a much coarser state than usual. A limit switch (LSP) detects a predetermined desired position of the bobbin rail (10), and the control element (28) outputs a signal directed to the unit (29), whereby the main motor (M1) and the control motor (M2) are stopped.

12 Claims, 6 Drawing Sheets

DEVICE FOR STOPPING BOBBIN RAIL OF FLYER FRAME AT A DESIRED POSITION

BACKGROUND OF THE INVENTION

1. Field of the Invention

The present invention relates to a flyer frame, and more particularly, to a device for stopping a bobbin rail of the flyer frame at a desired position after a full bobbin state is obtained.

2. Description of the Related Art

Known in the prior art is an automatic bobbin conveyor system used in a spinning factory, wherein conveyor lines connected between flyer frames and spinning frames are provided at the ceiling of the factory, for carrying bobbin carriages suspending full bobbins along the conveyor lines from the flyer frames, and delivering the same to auxiliary rails of creels of the respective spinning frames. Almost empty bobbins at the creel stands of the respective spinning frames are then replaced by the full bobbins at the auxiliary rails, and an ending process is carried out for introducing an end of a roving of a full bobbin into a trumpet of the spinning frame. The roving remaining on the almost empty bobbin is then removed, to thereby obtain an empty bobbin which is then returned to the flyer frame for repeated use thereof.

In such a system, a mechanism is employed for obtaining an automatic ending operation upon a replacement of the bobbins at the spinning frames. Such an automatic ending mechanism is provided with a suction nozzle for engaging the free end of the roving of a full bobbin, to draw out a predetermined length of the roving therefrom by unwinding same, and the suction nozzle holding the end of the roving is then moved to a trumpet of a draft roller unit of a spinning frame, for introducing the roving end into the trumpet to thereby carry out an ending operation. (See, for example, Japanese Unexamined Patent Publication No. 62-53425 and Japanese Unexamined Patent Publication No. 64-52828.) To obtain a desired ending operation by such an automatic ending mechanism, a free end of a roving of a full bobbin is located and held at a predetermined fixed height from the bottom end thereof, to thus bring the free end of the roving to a position facing the inlet opening of the nozzle of the automatic ending mechanism.

As is well known, a full bobbin state at the flyer frame is detected by a sensor for detecting when a predetermined length of the roving is wound on a bobbin. In the prior art, to obtain the predetermined location of the free end of the roving of a bobbin, so as to facilitate the ending operation at the spinning frame, the flyer frame continues to operate even after the detection of the full bobbin state, until the bobbin rail holding the bobbins reaches a predetermined vertical position corresponding to the desired vertical location of the free end of the roving of the bobbin, without changing the speed of the vertical reciprocation movement of the bobbin rail.

Note, the predetermined constant vertical position of the bobbin rail when a predetermined length of the roving is wound on a bobbin is, in general, not always obtained because errors inevitably occur in the parameters determining the length of the roving wound on the bobbin such as, for example, a tension of the roving, while winding same. Furthermore, when the full bobbin condition is obtained, the bobbin rail is usually stopped when moved upward, to thereby prevent a switching of the bobbin rail when the bobbin rail is moved downward to carry out a doffing operation. Where a full bobbin condition is obtained just after the bobbin rail has passed the above-mentioned predetermined position, during the upward movement of the bobbin rail, the bobbin rail must be stopped at the predetermined position after the completion of almost one complete upward and downward movement, while the spinning is continued. This causes an excessive amount of the roving of two winding layers having a length of as much as 70 to 80 yards to be wound, as the average value of the count thereof after the predetermined length of the roving on the bobbin is obtained, which is the maximum value of the error in length generated in full bobbins to be doffed.

SUMMARY OF THE INVENTION

An object of the present invention is to provide a flyer spinning frame capable of overcoming the above-mentioned difficulties of the prior art.

According to the present invention, a flyer frame is provided, comprising:

a drafting unit;

a bobbin rail on which bobbins are mounted;

means for rotating bobbins on the bobbin rail for taking up a roving from the drafting unit on the respective bobbins;

reciprocating means for obtaining a vertical reciprocating movement of the bobbin rail, said reciprocating means being capable of varying speed of the movement of the bobbin rail independent from an usual speed of the roving when it is wound for carrying out an usual shaping operation;

first detecting means for detecting a full bobbin state of the bobbins wherein a desired amount of roving has been taken up on the bobbin;

second detecting means for detecting a desired vertical position of the bobbin rail;

operating means, upon the detecting of the full bobbin state, for operating the reciprocating means so that an increased speed of the movement of the bobbin rail is obtained over a speed of the bobbin rail during the usual shaping operation;

stopping means, upon the detection of the desired vertical position of the bobbin rail, for stoppage of the flyer frame.

When a full bobbin state is obtained by detecting that the desired length of the roving has been taken up by the respective bobbins, an increase in the speed of the bobbin rail to the desired position thereof, for increasing a winding pitch of the roving wound on the bobbins, is obtained, and as a result, time from the detection of the full bobbin state to the detection of the desired position of the bobbin rail is shortened, and accordingly, the amount of excess roving wound on the bobbins after the detection of the full bobbin state is reduced.

According to the present invention, a spinning process at a later stage by a spinning frame can reduce the amount of waste at the empty bobbins when such bobbins are exchanged for full bobbins. Furthermore, the present invention can be easily practiced by a relatively simple modification of an existing flyer frame, without the need for the attaching of special devices thereto, and without an undue increase in the cost.

DESCRIPTION OF THE PREFERRED EMBODIMENTS

Figure 1:
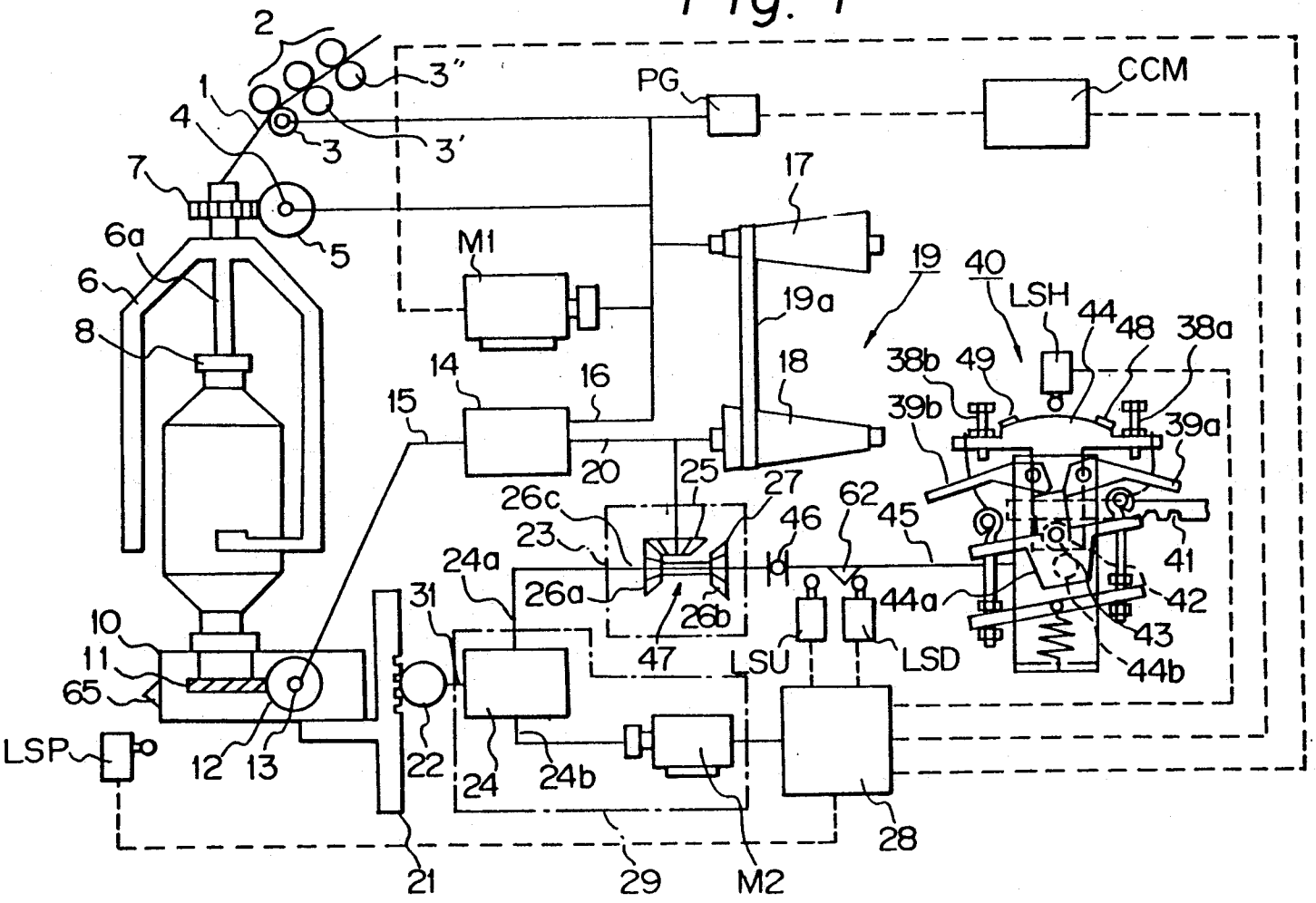
FIG. 1 is a general view of the construction of the flyer frame according to the present invention.

Referring to FIG. 1, a flyer frame is basically constructed by a drafting unit 2, a flyer 6, and a bobbin rail 10. The drafting unit 2 includes a plurality of spaced-apart sets of rollers 3, 3, and 3", and is connected to a main electric motor M1 via a belt and gear transmission mechanism, schematically illustrated, so that the rotation of the electric motor M1 is transmitted to the drafting unit 2. This gear transmission mechanism is provided with a shaft 4 on which a driven gear 5, which is engaged with a driven gear 7 provided on a spindle 6*a* of the flyer 6, is mounted so that the flyer 6 is rotated about the axis of rotation thereof. A bobbin wheel 11, with which a gear 12 mounted on a bobbin shaft 13 is engaged, is rotatably supported at the bobbin rail 10. The bobbin shaft 13 is connected, via a universal joint and a gear transmission mechanism, to an outer shaft (or differential shaft) 15 of a differential device 14. As well known to those skilled in this art, the differential gear device 14 is, in addition to the outlet shaft 15, provided with a first inlet shaft (or first rotating shaft) 16 connected to a main electric motor M1 and a second inlet shaft (or second rotating shaft) 20 connected to a cone drum 18 which, together with another cone drum, constructs a cone belt type speed variation mechanism 19. As a result, the rotation of the first inlet shaft 16 by the main motor M1 and the rotation of the second shaft by the cone drum 18 of the speed variation mechanism 19 are combined at the differential mechanism 14 to obtain the rotation of the outlet shaft 15, to thereby cause the bobbins 8 to be rotated.

A lifter rack 21, with which a gear 22 is engaged, is fixedly connected to the bobbin rail 10. The gear 22 is connected, via an elevating mechanism 29 and a directional switching mechanism 23, to the rotating shaft 20 of the differential mechanism 14. The elevating mechanism 29 is constructed by a reversible type second electric motor M2 of a fixed speed and a second differential gear mechanism 24. A control unit 28 is provided for producing an electric signal to thereby vary the speed of the output shaft of the second motor M2. The second differential gear mechanism 24 has a first inlet shaft 24*a* connected to the directional switching mechanism 23, a second inlet shaft 24*b* connected to the second electric motor M2, and an output shaft (or differential shaft) 31 connected to the gear wheel 22. As a result, a rotation of the first inlet shaft 24*a* transmitted from the rotating shaft 20 and a rotation of the second inlet shaft 24*b* transmitted from the second motor M2 are combined at the second differential mechanism 24, to thereby obtain a rotation of the outlet shaft 31 in such a manner that, when a rotational movement is applied to the second inlet shaft 24*b* from the variable speed motor M2 in a direction coinciding with the direction of rotation of the first inlet shaft 24*a*, an increase in the rotational speed at the differential shaft 31 is obtained. As a result, a speed of the vertical reciprocal movement of the bobbin rail 10 can be controlled by the differential gear mechanism 24 and motor M2, when rotated, independently from the usual control of the speed of the vertical reciprocal movement of the bobbin rail 21 during a normal winding process of a roving, wherein the rotation of the motor M2 is stopped.

As in the conventional manner, a shaping mechanism 40 provided includes a rack anchor bar 41. The rack anchor bar 41 has a first end slidably supported in a horizontally elongated hole in a double anchor bar bracket (not shown), which moves upward or downward together with the bobbin rail 10, and a second end fitted to a holder (not shown) located on the back side of the stagger horn 44, which is mounted to a pinion shaft 43 to obtain a rocking movement about the axis of the pinion shaft 43. The rack anchor bar 41 forms a rack portion which is engaged with a pinion 42 mounted on a pinion shaft 43. As a result, the upward or downward movement of the bobbin rail 10 causes the pinion 42 and the stagger horn 44 to produce combined rocking movement thereof about the axis of the pinion shaft 43. The stagger horn 44 is in the horizontal position, as shown in FIG. 1, when the bobbin rail 10 is at the middle of a normal vertical stroke of the upward or downward reciprocal movement thereof when carrying out a usual winding process. A pair of catches 39*a* and 39*b* are pivotably mounted on the stagger horn 44, and a pair of corresponding adjustable abutment members 38*a* and 38*b*, formed as bolts, are arranged on the stagger horn 44, such that the bottom ends of abutment members 38*a* and 38*b* face the corresponding catches 39*a* and 39*b* for an alternate inclination movement of a reversing bracket 44*a* about the axis of a shaft 44*b*. A downward movement of the bottom of the bobbin rail 10 to a lowest position thereof causes the stagger horn 44 to be rotated in a clockwise direction, and this causes the abutment member 38*a* to be engaged with the corresponding catch 39*a* when the bobbin rail 10 is at a position just before its lowermost position, thus allowing the catch 39*a* to be disengaged from the reversing bracket 44*a* under a first inclined position as shown, and allowing the bracket 44*a* to be turned in a clockwise direction about the axis of the shaft 44*b* until another inclined position is obtained at which the catch 39*b* is engaged with the corresponding abutment member 38*b*, for switching the movement of the bobbin rail 10 to an upward direction. The upward movement of the bobbin rail 10 causes the stagger horn 44 to be rotated in a counterclockwise direction, which causes the abutment member 38*b* to be engaged with the corresponding catch 39*b* when the bobbin rail 10 is located at a position just before the top most position thereof, thus allowing the catch 39b to be disengaged from the reversing bracket 44a under the second inclined position, and allowing the bracket 44a to be turned in a counterclockwise direction about the axis of the shaft 44b until the first inclined position is obtained, for switching the movement of the bobbin rail 10 to the downward direction.

The bottom end of the reversing bracket 44a is connected, via a universal joint 46, to a switching gear box 47 having a switching bevel gear 25, and a pair of axially faced bevel gears 26a and 26b, axially slidable on a shaft 26c while rotating with the shaft 26c. The rocking movements of the reversing bracket 44a between the first and second inclined positions are transformed via the connection lever 45 and the universal joint 46 to an axial reciprocal sliding movement of the bevel gears 26a and 26b between a position at which the switching bevel gear 25 is meshed with the first bevel gear 26a, to obtain the downward movement of the bobbin rail 10, and a position at which the switching bevel gear 25 is meshed with the second bevel gear 26b, to obtain the upward movement of the bobbin rail 10. A cam portion 62 is formed on the connection lever 45, and a pair of limit switches LSD and LSU are stationarily arranged astride the cam portion 62.

A limit switch LSH is arranged slightly above the stagger horn 44, and the stagger horn 44 has a pair of spaced-apart cam portions 48 and 49 formed on the top surface thereof facing the limit switch LSH. The upward movement of the bobbin rail 10 causes the stagger horn 44 to be rotated in a counterclockwise direction, as described above, and the stagger horn 44 is at a right-hand raised and inclined position when the bobbin rail 10 approaches the topmost position thereof. Just before the bobbin rail 10 reaches the topmost position thereof, the right-side cam portion 48 is brought into contact with the limit switch LSH. Contrary to this, the downward movement of the bobbin rail 10 causes the stagger horn 44 to be rotated in a clockwise direction, as described above, and the stagger horn 44 is at the left-hand raised and inclined position when the bobbin rail 10 approaches the lowermost position thereof. Just before the bobbin rail 10 reaches the lowermost position thereof, the left-side cam portion 49 is brought into contact with the limit switch LSH. The limit switch LSH is connected to the control means 28 for outputting a signal indicating that the switch LSH is activated.

In accordance with a well-known technique, the reciprocal rocking movements of the reversing bracket 44a between the right-hand raised and inclined position and the left-hand raised and inclined position allow a pair of catch members (not shown) to be alternately engaged with a shaper changing wheel (not shown), which is urged to rotate in one direction by a predetermined angle corresponding to a half of the number of teeth of the shaper changing wheel, by a weight (not shown). On one hand, this causes a cone belt 19a to be moved for a predetermined length by a long rack (not shown), in a direction decreasing the winding-up speed of the roving on the bobbin, and on the other hand, causes the pinion 42 to be rotated by a predetermined small angle in a counterclockwise direction to cause the rack anchor bar 41 to be moved in the left-hand direction, resulting in a corresponding shortening of the length of the reciprocating movement of the bobbin rail 10, and thereby shaping the tapered top and bottom ends of the roving wound on the bobbin.

A pulse generator PG is connected to the front roller 3 of the drafting apparatus 2 for generating a pulse signal corresponding to a rotational speed of the front roller 3, and a counter CCM outputting a signal directed to the control means 28 when the number of pulses counted by the counter 3 reaches a predetermined value, which corresponds to the desired length of the roving corresponding full bobbin state and is connected to the pulse generator PG. Also, limit switches LSD and LSU, between which a cam portion 62 is formed on the connecting lever 45, are connected to the control means 28. When the bobbin rail 10 is moved downward toward the lowermost position thereof, to case the abutment 38a to be engaged with the catch 39a, and move the bracket 44a at the right-hand raised position to a left-hand side raised position, to thus cause the connection lever 45 to move in the left-hand direction and engage the bevel gear 25 with the gear 26a, the cam portion 62 on the connection lever 45 is engaged with the limit switch LSU, which then outputs an activated signal. Contrary to this, when the bobbin rail 10 is moved upward to the top most position thereof, to cause the abutment 38b to be engaged with the catch 39b and move the reversing bracket 44a at the left-hand raised position to the right-hand raised position, to thus cause the connection lever 45 to move in the right-hand direction and engage the bevel gear 25 with the gear 26b, the cam portion 62 on the connection lever 45 is engaged with the limit switch LSD, which then outputs an activated signal.

Furthermore, another limit switch LSP is provided for cooperation with a cam portion 65 formed on the bobbin rail 10. The arrangement between the limit switch LSP and the cam portion 65 is such that the limit switch LSP is activated only when the bobbin rail is moved upward and when the bobbin rail is situated at a desired position, which is substantially a middle point of its range of vertical reciprocal movement desirable for the following automatic ending process at a spinning frame. In other words, the downward movement of the bobbin rail 10 does not cause the limit switch LSP to be activated, even if the cam portion 65 is engaged with the limit switch LSP. The limit switch LSP is also connected to the control means 28.

Figure 2:
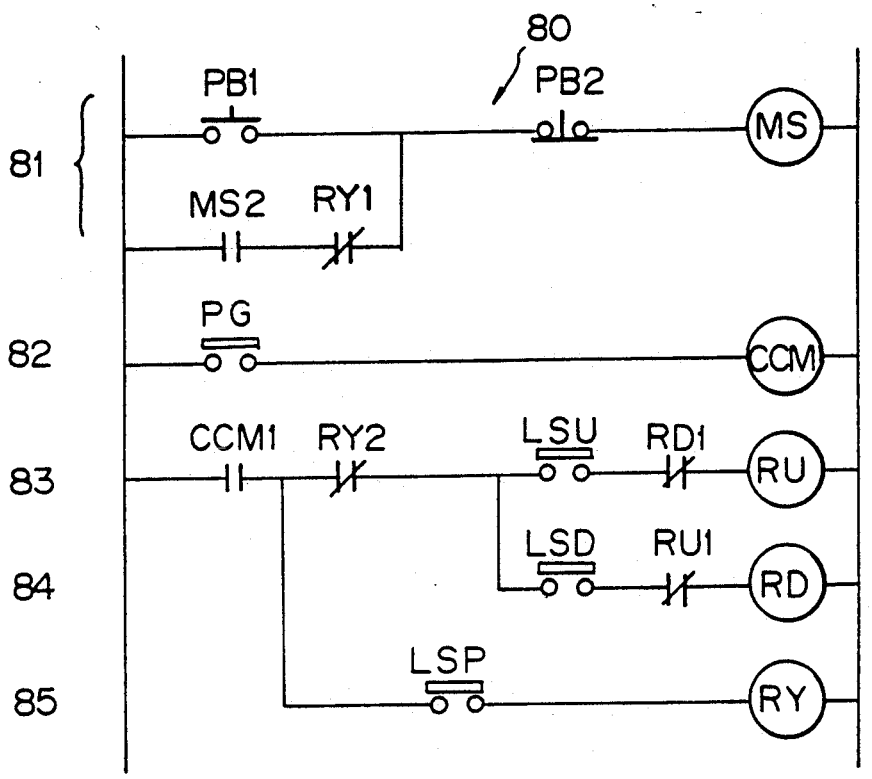
FIG. 2 shows details of a control circuit for controlling the operation of a main motor and a control motor.
Figure 3:
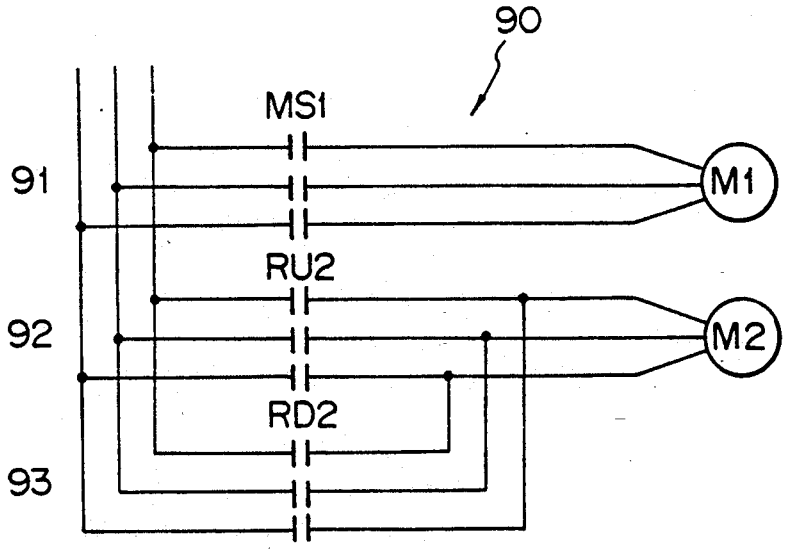
FIG. 3 shows details of an electric circuit at windings of the main motor and the control motor shown in FIG. 2.

A construction of the control means 28 will now be explained. To obtain a related control between the main electric motor M1 and a control electric motor M2, for obtaining an increased speed of the bobbin rail 10 to the desired position of the bobbin rail 10 when moving upward after a full bobbin state is obtained, the control means 28 is provided with a control circuit 80 shown in FIG. 2, for controlling the lifting means for the bobbin rail 10, and a circuit 90 for controlling the electric motors M1 and M2 in FIG. 3. In FIG. 2, a relay MS is used for obtaining a rotation of the main motor M1, and has three normally-open contacts MS1 (FIG. 3) connected to respective windings of the main motor M1 and a normally-open contact MS2. A relay RU is used for a forward rotation of the control motor M2, and has a normally-closed contact RU1 (FIG. 2) and a set of normally-open contacts RU2 (FIG. 3) connected to respective windings of the control motor M2, for a forward rotation thereof. A relay RD is used for a rearward rotation of the control motor M2, and has a normally-closed contact RD1 (FIG. 2) and a set of normally-open contacts RD2 (FIG. 3) connected to respective windings of the control motor M2, for a rearward rotation therof. A relay RY is used for a detection of a desired position of the bobbin rail, and has normally-closed contacts RY1 and RY2.

In FIG. 2, the control circuit 80 includes a circuit section 81 for energizing or de-energizing the main motor M1, and includes a normally opened push button switch PB1 for starting and a normally closed push button switch PB2 for stopping, connected in series to the relay MS for operating the main motor M1. The contact MS2 of the relay MS is connected to the contact RY1 of the positional detection relay RY1, as explained later, and the contact MS2 and the relay RY1, which are in series with each other, are connected to the start switch PB1 in parallel.

The control circuit 80 further includes circuit sections 82, 83, 84 and 85. The section 82 is constructed by the pulse generator PG and the counter CCM, which are in series with each other. The section 83 is used for obtaining a forward rotation of the control motor M2 and is constructed by a contact CCM1 of the counter CCM, the contact RY2 of the position detection relay RY, the limit switch LSU for confirming that the bobbin rail is at the topmost position thereof, the contact RD1 of a relay RD for obtaining a reverse movement, and the relay RU for obtaining a forward movement of the control motor M2, and these are connected in series with each other. The circuit section 84 is used for obtaining a rotation of the control motor M2, and is constructed by the limit switch LSD for confirming the lowermost position of the bobbin rail 10, the contact RU1 of the relay RU, and the relay RD for obtaining the reverse movement of the control motor M2, which are in series with each other, and which are parallel to the series connection between the LSU, RD1 and RU. The circuit section 85 is used for the detection of the desired position of the bobbin rail 10, and is constructed by the desired position detection limit switch LSP and the relay RY, which are in series with each other but are connected in parallel to the series connection of the RY2, LSU, RD1 and RU.

Now the operation of the control circuit 80 will be explained. When the push button switch PB1 for starting is operated, the relay MS is energized and the contacts MS1 (FIG. 3) thereof made ON, to energize the main motor M1, and to cause the contact MS2 therof to be turned ON to obtain a self-holding operation of the motor M1 even after the push button PB1 is depressed. Thus, a usual operation of the flyer frame is commenced, wherein the roving from the front roller device 2 is wound-up on the bobbin 8 while the bobbin rail 10 is reciprocally moved vertically. Such a downward or upward movement of the bobbin rail 10 causes a rocking movement of the stagger horn 44, which causes the reversing bracket 44*a* to be switched between right-hand raised position and the left-hand raised position, and therefore, the connection bar 45 is reciprocally moved horizontally, which causes the bobbin rail 10 to be switched between the upward movement and the downward movement, and thus the limit switches LSU and LSD on the connection lever 45 are alternately activated.

Figure 5:
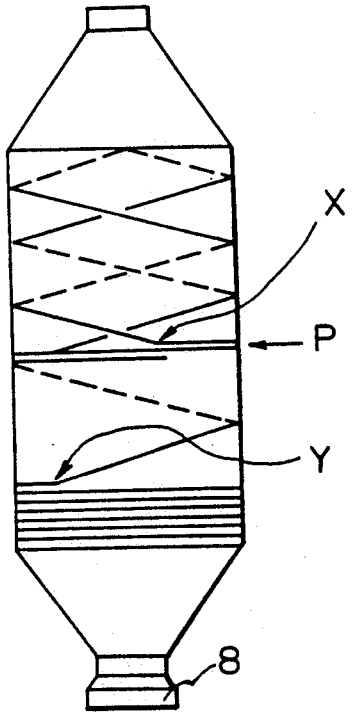
FIG. 5 shows a bobbin on which a roving is wound to a full bobbin state.

The counter CCM has a predetermined number corresponding to a desired length of the roving L corresponding to a full state of a bobbin 8, as shown in FIG. 5, and the pulse generator PG issues pulse signals at every rotation of the front roller 3, which signals are counted by the counter CCM. When the predetermined count is reached by the counter CCM, a full bobbin signal is issued, and the contact CCM1 of the counter CCM is turned ON. When the outlet shaft 31 is rotated forward, to move the bobbin rail upward at the timing of the output of the full bobbin signal, the limit switch LSU is maintained ON and the circuit 83 is closed, to energize the forward rotation relay RU, causing the contacts RU2 (FIG. 3) to be turned ON and the control motor M2 to be forward rotated. This forward rotation of the control motor M2 is introduced, via the shaft 24*b*, to the differential mechanism 24 whereby the forward rotational speed of the differential shaft 31 thereof is correspondingly increased. As a result, an increased speed of the upward movement of the lifter rack 21, i.e., the bobbin rail 10, which is higher than that obtained in the usual process, is obtained and causes the winding of the roving to the bobbin 8 to be much more coarse than that of the usual process.

Contrary to this, when the outlet shaft 31 is rotated rearward to move the bobbin rail downward at the timing of the output of the full bobbin signal, the limit switch LSD is maintained ON and the circuit 84 is closed to energize the rearward rotation relay RD, causing the contacts RD2 (FIG. 3) thereof to be of made ON, and the control motor M2 to be rearward rotated. This rearward rotation of the control motor M2 is introduced, via the shaft 24*b*, to the differential mechanism 24, whereby the rearward rotational speed of the differential shaft 31 thereof is correspondingly increased. As a result, an increased speed of the downward movement of the lifter rack 21, i.e., the bobbin rail 10, which is higher than that of the usual process, is obtained and causes the winding of the roving to the bobbin 8 to be much coarser than that of the usual process.

FIG. 5 illustrates the winding of the roving after the detection of the full bobbin state. When the full bobbin state is detected at a point X during the upward movement of the bobbin rail 10, after the bobbin rail 10 has passed the desired position P, the speed of the bobbin rail is increased to change the normally closely wound state to a coarse wound state. This coarse wound state is continued until the predetermined position P is detected during the upward movement of the bobbin rail 10. When the full bobbin state is detected at a point y during the upward movement of the bobbin rail 10, before the bobbin rail 10 reaches the desired position P, the speed of the bobbin rail is increased to change the normally closely wound state to a coarse wound state. This coarse wound state is continued until the predetermined position P is detected during the upward movement of the bobbin rail 10.

As is clear from the above, after the full bobbin state is obtained, an increased speed in the direction in which the bobbin rail 10 is moving is obtained. When the bobbin rail 10, during the upward movement thereof, reaches the predetermined position P as shown in FIG. 5, which is located substantially at the middle of the range of the reciprocal movement of the bobbin rail 10 and is suitable for the ending process at the following spinning process, the cam 65 on the bobbin, rail 10 is engaged with the limit switch LSP and turned ON, causing a proper position signal to be issued. This causes the circuit 85 to be closed and the relay RY to be energized, causing both of the contacts RY1 and RY2 thereof to be turned OFF and the circuits 83 to be opened for stopping the control motor M2, and the circuit 81 to be opened for stopping the main motor M1. As a result, when the full bobbin state is obtained, corresponding to the desired length L of the roving on the bobbin 8, an increased speed of the bobbin rail 10 which is higher than the usual speed is obtained, and the bobbin rail 10 is stopped when it reaches the predetermined suitable position P, when the bobbin rail moves upward.

The increased speed of the bobbin rail after the full bobbin state which is obtained according to the present invention, can reduce the amount of the roving taken up on the bobbin until the predetermined position is obtained, compared with that in the prior art wherein even after the full bobbin state, the bobbin rail moves at the same speed as that before the full bobbin state is obtained. It should be noted that, when the full bobbin state signal and the proper position signal are issued at substantially the same timing, the relay RY is energized to open the normally closed contact RY1 in the circuit 81 and the normally closed contact RY2 in the circuit 83, whereby the relays MS, RU and RD are de-energized, and thus the contact MS1 in the circuit 91 is opened to stop the main motor M1, and further, the contacts RU2 in the circuit 92 and the contacts RD2 in the circuit 93 are opened to stop the control motor M2.

Figure 4:
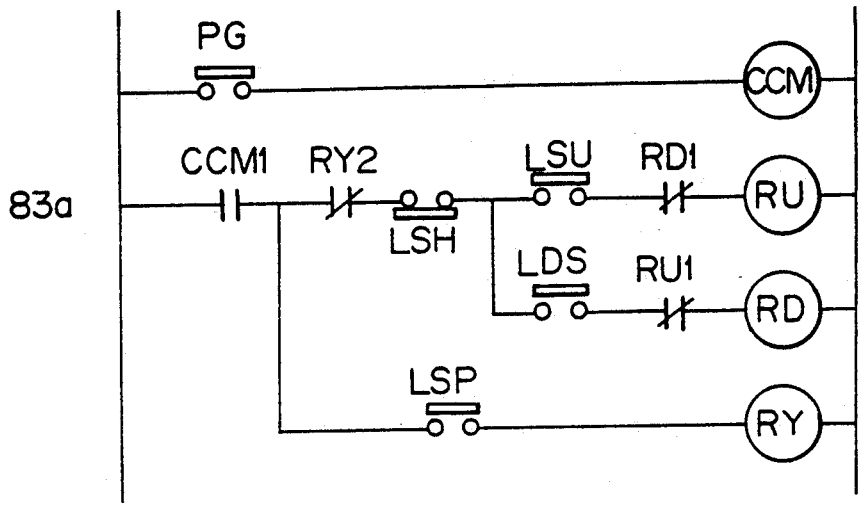
FIG. 4 is similar to FIG. 2, but is directed to a modification thereof.
Figure 6:
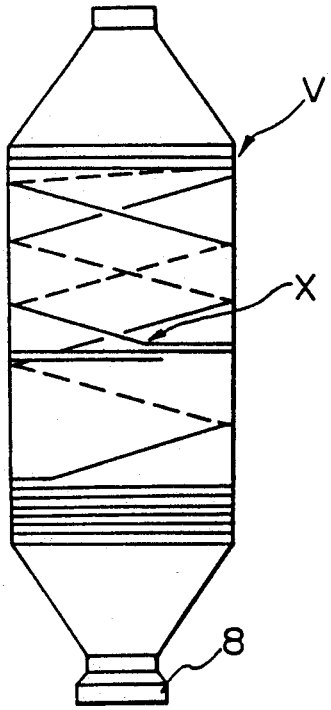
FIG. 6 shows a full bobbin state, but in another embodiment thereof.

In a modification, the limit switch LSH is used for reducing the speed of the bobbin rail at the end of the reciprocal movement thereof. The limit switch LSH cooperates with the pair of cam portions 48 and 49 formed on the stagger horn 44, which is subjected to a rocking motion between a pair of angularly spaced limit positions in accordance with an upward or downward movement of the bobbin rail 10, so that the limit switch LSH is alternately activated by the cam portion 48 or 49 when the stab horn 48 approaches the respective limit position, i.e., top or bottom position of the bobbin rail 10. As shown in FIG. 4, the limit switch LSH is located between the relay contact RY2 and the limit switches LSU in the circuit 83*a*. The limit switch LSH, in a usual range of the reciprocating movement of the bobbin rail 10 far from the top and bottom end, is closed, and therefore, the circuit 83*a*, after the full bobbin state is obtained and before the desired stopping position is reached, is closed to energize the forward rotation control relay RU and increase the speed of the bobbin rail 10 when the bobbin rail 10 moves upward, or to energize the reverse rotation control relay RD to increase the speed of the bobbin rail 10 when the bobbin rail moves downward. When the bobbin rail 10 is located near the top or bottom end, where the direction of the movement of the bobbin rail 10 is changed, the normally closed limit switch LSH is opened, to open the circuit 83*a* and de-energize the relays RU and RD, to temporarily stop the operation of the control motor M2 and causes the bobbin rail 10 to temporarily move at the normal reduced speed at the region where the direction of the movement of the bobbin rail 10 is switched. Such a normal speed control of the bobbin speed at a top or bottom region where the directional change of the movement takes place effectively prevents the moving of the roving wound on a bobbin at the area near the edges of bobbins, which otherwise would occur if the winding pitch is made large due to the high speed movement of the bobbin rail. In FIG. 6, when the bobbin rail approaches, for example, the top end, the coarse winding after the detection of the full bobbin state is temporarily stopped, and a usual close winding as shown by v is obtained.

Figure 7:
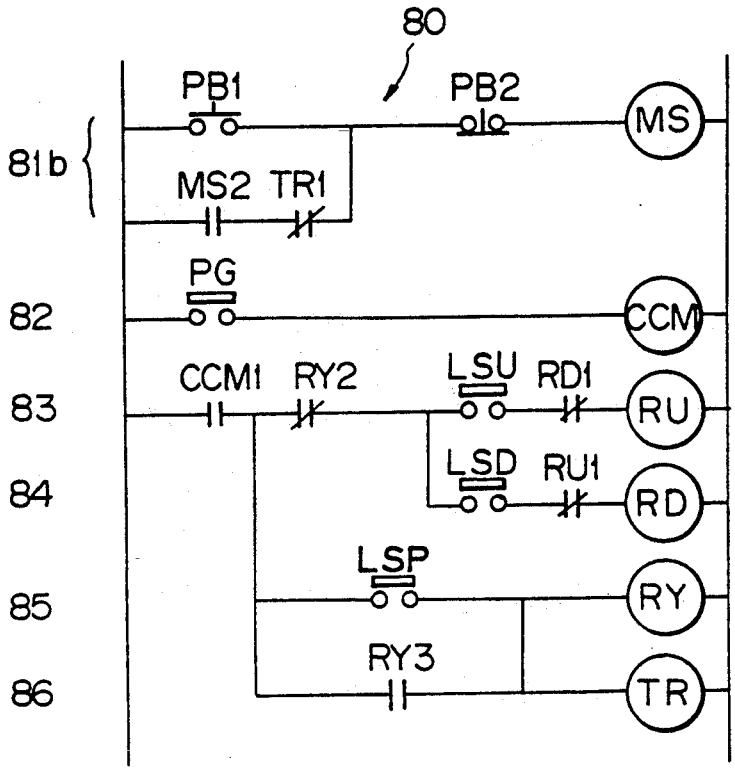
FIGS. 7 and 8 are similar to FIG. 2, but are directed to different embodiments thereof, respectively.

FIG. 7 shows another embodiment of the present invention, wherein a timer TR is provided and is operated when the limit switch LSP detects the proper position of the bobbin rail 10. The relay RY, which is operated when a proper position is detected by the limit switch LSP, has a another normally opened contact RY3, and the timer TR is connected to the normally opened contact RY3 of the relay RY in series, the limit switch LSP is connected in parallel to the contact RY3 of the relay RY3, and the relay RY is connected in parallel to the timer TR. The timer relay TR is provided with a normally closed timer contact TR1, connected in series to the contact MS2 of the main motor relay MS. Namely, the contact TR1 is used in place of the contact TY1 in FIG. 2.

In the operation of the embodiment in FIG. 7, as in the first embodiment in FIG. 2, a detection of the full bobbin state causes the counter COM to be energized, causing the forward or rearward relay RU of RD to be alterantly operated to obtain an increased upward or downward movement of the bobbin rail 10. Upon a detection of the proper position P after the full bobbin position is obtained during the upward movement of the bobbin rail 10, the proper position relay RY is operated to cause the normally closed contact RY2 of the relay RY to be opened, which causes the control motor M2 to be deenergized, to stop the speed increase operation. At this instant, the relay contact TR1 is maintained closed, so that the main relay remains energized, causing the main motor M1 to continue to rotate to obtain the movement of the bobbin rail 10 under the normal reduced speed, so that a close winding of the roving wound on the bobbin at a position adjacent to the predetermined position is obtained. When a predetermined short time, such as 5 seconds, has elapsed, the relay contact TR1 is opened, causing the main relay MS to be de-energized and the main motor M1 to be stopped. As clear from the description, the embodiment in FIG. 7 obtains an increased amount of the roving wound at the opposition adjacent to the predetermined position, which is advantageous in that a location of the roving when taken out from the full bobbin is unchanged even if a relatively large amount of roving is wasted by sucking the roving by a nozzle when an ending process is carried out at a later process (spinning process).

Figure 8:
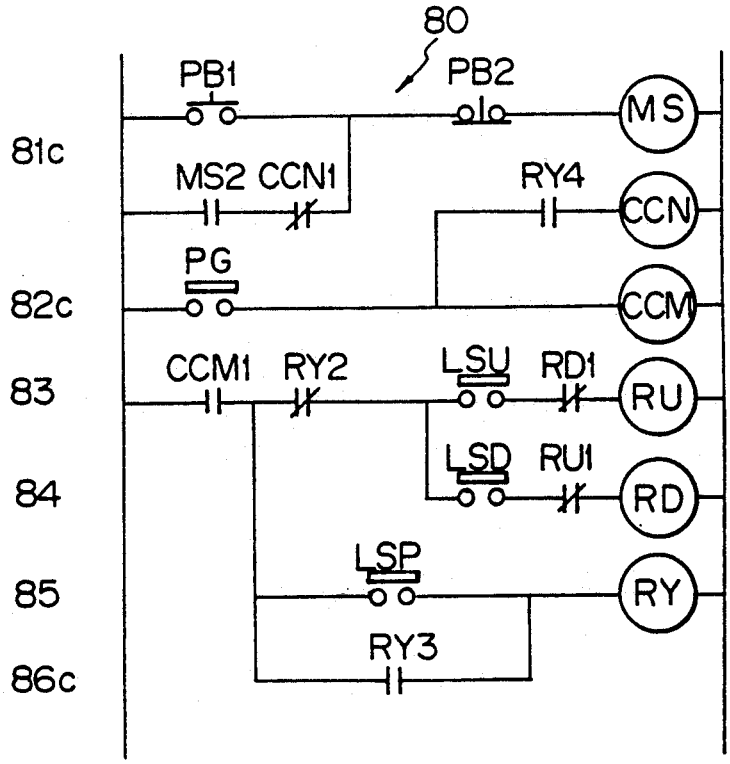

FIG. 8 shows another embodiment, and differs from the first embodiment in that the proper position detection relay RY is provided with other normally opened contacts RY3 and RY4, and another counter CCN is provided in series with the contact RY4. The counter CCN is, similar to the counter CCM, connected to the pulse generator PG for a detection of the length of the roving wound on the bobbin. The series connected counter CCN and contact RY4 are connected in parallel to the counter CCM. The contact of the relay RY3 is connected in parallel to the proper position detection limit switch LSP. The counter has a normally-open contact CCN1 provided in place of the contact RY1 in FIG. 2, i.e., the contact MS2 of the main relay MS is connected in series to the contact CCN1, and the series connection of the MS2 and CCN1 is connected in parallel to the push button switch.

In the operation of the embodiment in FIG. 8, as in the first embodiment in FIG. 2, a detection of the full bobbin state causes the counter COM to be energized, causing the forward or rearward relay RU of RD to be alternately operated to obtain an increased upward or downward movement of the bobbin rail 10. Upon a detection of the proper position P after the full bobbin position is obtained during the upward movement of the bobbin rail 10, the proper position relay RY is operated to open the normally closed contact RY2 of the relay RY, which causes the control motor M2 to be de-energized, to stop the speed increase operation, and closes the normally opened contact RY4 to commence the operation of the counter CCN. At this instant, the relay contact CCN1 is maintained closed, so that the main relay remains energized, causing the main motor M1 to continue to rotate to obtain the movement of the bobbin rail 10 under the normal reduced speed, whereby a close winding of the roving wound on the bobbin at the position adjacent to the predetermined position is obtained. When a predetermined length of the roving is wound on the bobbin after the detection of the proper stopping position, the counter CCN is energized to open the normally closed contact CCN1, causing the main motor M1 to be stopped. As clear from the description, as in the embodiment in FIG. 7, the embodiment in FIG. 8 obtains an increased amount of the roving wound at the position adjacent to the predetermined position before the device is stopped.

As an alternative to the embodiments in FIG. 7 or 8, to obtain an increased amount of roving wound on the bobbin at the proper position therefore, before the stoppage of the bobbin rail, an inverter is provided for controlling the operation of the rotation of the main motor M1, and a control means is provided, responsive to a signal from the contact RY1 of the relay RY energized by the detection of the proper position of the bobbin rail, for obtaining an increased time for reducing the speed of the main motor M1.

Figure 9:
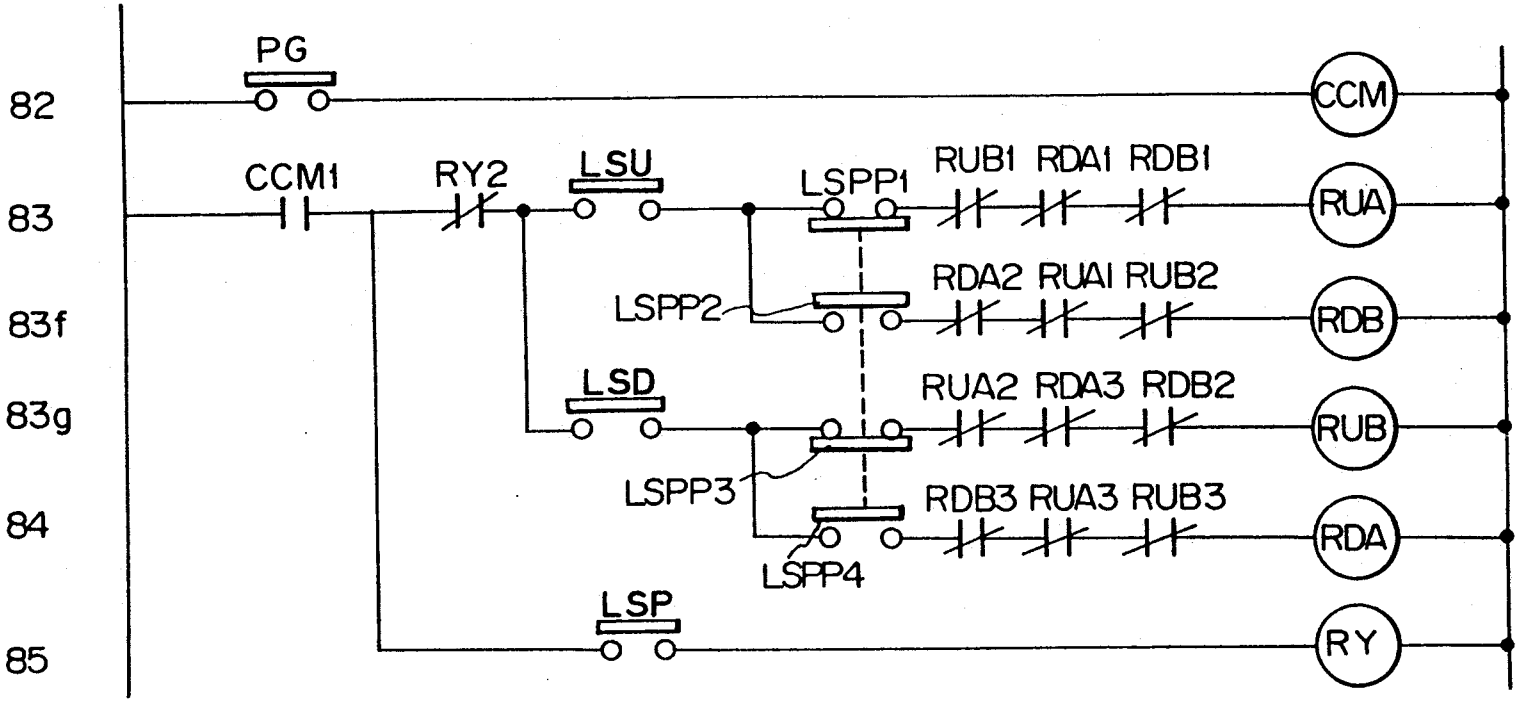
FIG. 9 is similar to FIG. 2, but is also directed to another embodiment thereof.
Figure 10:
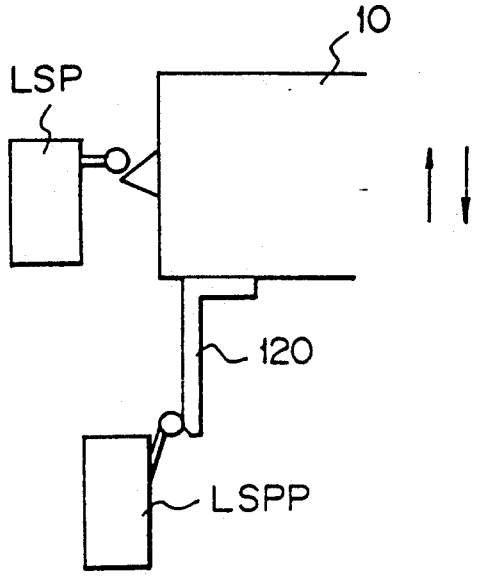
FIG. 10 is a schematic view of the embodiment of FIG. 9, showing a positional relationship between limit switches and bobbin rail.
Figure 11:
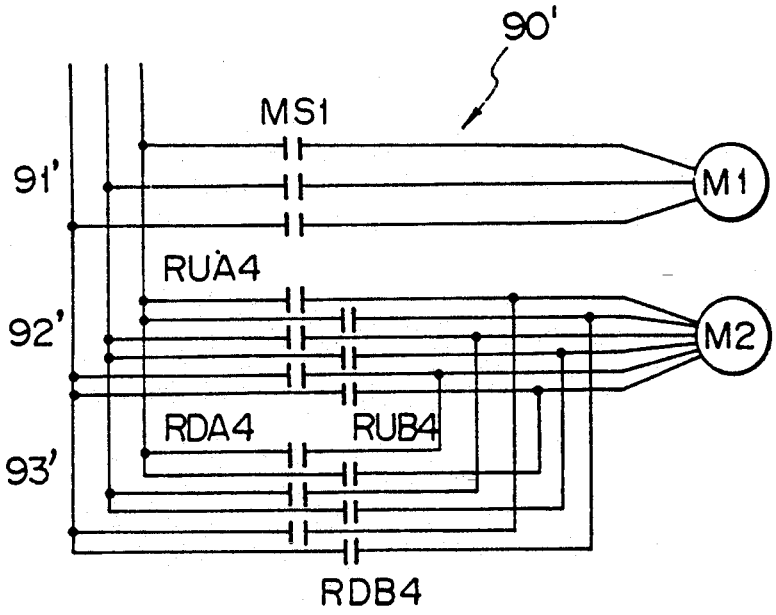
FIG. 11 is a schematic illustration of a circuit for operating the main motor and control motor in the embodiment in FIG. 9.

FIGS. 9 and 10 show another embodiment provided with a limit switch LSPP for a detection of a position of a bobbin rail below the desired position for the stoppage, which has a stylus as shown in FIG. 10 in contact with a cam plate 120 at a position of bobbin rail 10 slightly below the position at which the cam 65 is in contact with the limit switch 65. The limit switch LSPP has a normally closed first contact LSPP1, a normally open second contact LSPP2, a normally closed third contact LSPP3, and normally open fourth contact LSPP4. The control circuit is further provided with a relay RUA for controlling the usual forward rotation and having a normally closed contact RUA1, RUA2 and RUA3, a relay RDA for controlling the usual reverse rotation and having normally closed contacts RDA1, RDA2, and RDA3, a relay RUB for controlling a faster forward rotation and having normally closed contacts RUB1, RUB2 and RUB3, and a relay RDB for controlling a faster reverse rotation and having normally closed contacts RDB1, RDB2 and RDB3. In a circuit 83, the usual forward rotation control relay RUA is connected in series with the contacts RUB1, RDA1 and RDB1, and the contacts LSPP1. In a circuit 83*f*, the faster reverse rotation control relay RDB is connected in series with the contacts RDA2, RUA1 and RUB2, and the contacts LSPP2. In a circuit 83*g*, the faster forward rotation control relay PUB is connected in series with the contacts RUA2, RDA3 and RDB2, and the contacts LSPP3. In a circuit 84, the usual reverse rotation control relay RDA is connected in series with the contacts RDB3, RUA3 and RUB3, and the contacts LSPP4. As shown in FIG. 11, the relay RUA further has normally open contacts RUA4 for obtaining a forward rotation of the control motor M2 at a usual speed, and the relay RUB further has normally open contacts RUB4 for obtaining a forward rotation of the control motor M2 at a higher speed. The relay RDA further has normally open contacts RDA4 for obtaining a rearward rotation of the control motor M2 at a usual speed, and the relay RDB further has normally open contacts RDB4 for obtaining a rearward rotation of the control motor M2 at a higher speed. In short, the control motor M2 in this embodiment is variable speed type having to kind of windings for obtaining the low speed and high speed, respectively, each of which is reversible.

The operation of this embodiment is as follows: When the bobbin rail 10 is located below the desired position for the stopping thereof during the upward movement caused by the detection of the full bobbin state (output of ON signal for the counter contact CCM1), the relay RUA is energized by the closing of the limit switch LSPP1, so that a forward rotation of the control motor M2 is obtained by the ON condition of the contact RUA4 in FIG. 11, to increase the speed of the upward movement of the bobbin rail 10 until a detection of the desired position, which is detected by the limit switch LSP to thereby stop the bobbin rail 10.

When the bobbin rail 10 is located above the desired position for stopping during the upward movement thereof upon the detection of the full bobbin state, the relay RDB is energized due to the closure of the limit switch LSPP2, which causes the control motor M2 to be subjected to a faster rearward rotation due to ON condition of the contacts RDB4, supplied to the differential device 24, which causes the differential shaft 31 to be rotated rearward irrespective of the forward rotation of the main motor M1, and thus to switch the movement of the bobbin rail 10 to the downward direction in a manner such that the downward movement of the bobbin rail 10 is faster than the usual speed until the detection of the desired position by the limit switch LSP, to thereby stop the bobbin rail.

When the bobbin rail 10 is located above the desired position for stopping during the downward movement thereof upon the detection of the full bobbin state (output of ON signal for the counter contact CCM1), the relay RDA is energized due to the closure of the limit switch LSPP4, so that a rearward rotation of the control motor M2 is obtained to the ON condition of the contact RDA4, to increase the speed of the downward movement of the bobbin rail 10 until the detection of the desired position, which is detected by the limit switch LSP to thereby stop the bobbin rail 10.

When the bobbin rail 10 is located below the desired position for stopping during the downward movement upon the detection of the full bobbin state, the relay RUB is energized due to the closure of the limit switch LSPP3, which causes the control motor M2 to be subjected to a faster forward rotation due to the ON position of the contact RUB4, supplied to the differential device 24, which causes the differential shaft 31 to be rotated forward irrespective of the reverse rotation of the main motor M1, and causes a switch of the movement of the bobbin rail 10 to the upward direction in a manner such that the upward movement of the bobbin rail 10 is faster than the usual speed until the detection of the desired position by the limit switch LSP, to thereby stop the bobbin rail.

In this embodiment, the limit switches LSU and LSD can be eliminated, a forward rotation of the control motor M2 obtained when the limit switch LSPP is made OFF and a rearward rotation of the control motor M2 obtained when the limit switch LSPP is made ON, whereby the bobbin rail is moved toward the desired position at which it should be stopped.

It should be noted that the present invention can also be applied to such a flyer frame wherein, in place of a differential gear, an independent motor can be employed for obtaining a vertical reciprocal movement of the bobbin rail.

While the embodiments of the present invention are described with reference to attached drawings, many modifications and changes can be made by those skilled in this art without departing from the scope and spirit of the present invention.

We claim:

1. A flyer frame comprising:
a drafting unit;
a plurality of bobbins;
a bobbin rail on which said bobbins are mounted;
means for rotating said bobbins on the bobbin rail so as to take up a roving from the drafting unit on the respective bobbins;
reciprocating means for providing a vertical reciprocating movement of the bobbin rail, said reciprocating means capable of varying a speed of movement of the bobbin rail independent from a usual speed of the roving when it is wound for carrying out a usual shaping operation;
first detecting means for detecting a full bobbin state of the bobbins wherein a desired amount of roving has been taken up on the bobbin;
second detecting means for detecting a desired vertical position of the bobbin rail;
operating means, operatively associated with said first detecting means, for operating the reciprocating means, upon the detection of the full bobbin state, so as to increase the speed of movement of the bobbin rail over a speed of the bobbin rail during the usual shaping operation by a predetermined fixed amount;
stopping means, operatively associated with said second detecting means, for stopping the flyer frame upon the detection of the desired vertical position of the bobbin rail.

2. A flyer frame according to claim 1, further comprising means for detecting one of the directions of the vertical movement of the bobbin rail, and means for stopping the flyer frame upon the detection of the desired vertical position of the bobbin rail when the bobbin rail is moving in said one direction.

3. A flyer frame according to claim 2, wherein said one direction as to be detected in an upward direction.

4. A flyer frame according to claim 1, further comprising a third detection means for detecting a position of the bobbin rail when the roving taken up is located adjacent to shoulder portions of the respective bobbins, and means for cancelling the operation of the operating means so that speed of the bobbin rail is reduced to the usual speed when it is detected that the roving is taken up on the respective bobbin at the area adjacent to the shoulder portions, even after a detection of the full bobbin state.

5. A flyer frame according to claim 1, further comprising second operating means for operating, for a predetermined short time, the reciprocating means so that the bobbin rail is moved at the reduced speed after the detection of the desired position of the bobbin rail, and before the stopping of the frame by the stopping means.

6. A flyer frame according to claim 5, wherein said second operating means comprise timer means for detecting the lapsed time after the detection of the desired position, and means determining if the lapse time is longer than a predetermined value for allowing the stopping means to stop the flyer frame.

7. A flyer frame according to claim 5, wherein said second operating means comprise means for detection of the length of the roving as wound, and means determining if the length of the roving as wound larger than a predetermined value for allowing the stopping means to stop the flyer frame.

8. A flyer frame comprising;
a drafting unit;
a plurality of bobbins;
a bobbin rail on which said bobbins are mounted;
means for rotating said bobbins on the bobbin rail so as to take up a roving from the drafting unit on the respective bobbins;
reciprocating means, receiving a two directional rotational movement, for providing a vertical reciprocating movement of the bobbin rail in accordance with the direction of the rotational movement to be applied;
a first rotating means for obtaining a rotating movement applied to the reciprocating means for obtaining a usual speed of the reciprocating movement of the bobbin rail for carrying out a shaping operation of the roving on the respective bobbins;
first detecting means for detecting a full bobbin state of the bobbins wherein a desired amount of roving has been taken up on the bobbin;
second detecting means for detecting a desired vertical position of the bobbin rail;
second rotating means for generating, upon the detection of the full bobbin state by the first detecting means, a rotational movement independent from that obtained by the first rotating means, said second rotating means for obtaining a vertical reciprocating movement of the bobbin rail which is faster, by a predetermined fixed amount, than that obtained by the first rotating means;
means, upon the detection of the desired vertical position of the bobbin rail, for stopping the flyer frame.

9. A flyer frame according to claim 8, wherein said second rotating means comprise a differential gear arranged between the first rotating means and the reciprocating means, a reversible rotating motor connected to the differential gear for adding the rotational movement from the reversible rotating motor to the differential gear, and means for detecting the direction of the movement of the bobbin rail so as to control the direction of the rotation as obtained by the reversible rotating motor so that an increased speed of said predetermined fixed amount of the rotational movement from the differential gear applied to the reciprocating means is obtained irrespective of the direction thereof.

10. A flyer frame comprising:
a drafting unit;
a plurality of bobbins;
a bobbin rail on which said bobbins are mounted;
means for rotating said bobbins on the bobbin rail so as to take up a roving from the drafting unit on the respective bobbins;
a first source for generating a two directional rotating movement;
reciprocating means receiving the rotational movement from the first source for obtaining a vertical reciprocating movement of the bobbin rail in accordance with the direction of the rotational movement for obtaining a usual speed of the reciprocating movement of the bobbin rail for carrying out a shaping operation of the roving on the respective bobbins;

a second source for generating a two differential rotational movement which is independent from the first source;

a differential gear arranged between the first source and the second source, and the reciprocating means for obtaining a combined rotational movement from the first and second sources which is applied to the reciprocating means for obtaining an increased speed of the bobbin rail irrespective of the direction of the movement of the bobbin rail;

first detecting means for detecting a full bobbins state of the bobbins wherein a desired amount of roving has been taken up on the bobbin;

second detecting means for detecting a desired vertical position of the bobbin rail when the bobbin rail moves upwardly;

operating means for operating the second source, upon the detection of the full bobbin state by the first detecting means, so that an increase speed of the reciprocating movement of the bobbin rail of a predetermined fixed amount is obtained, and;

means for stopping the flyer frame, upon the detection of the desired vertical position of the bobbin rail by the second detection means when the bobbin rail moves upwardly.

11. A flyer frame according to claim 10, wherein said second source comprise a reversible electric rotating motor connected to the differential gear for adding the rotational movement from the reversible rotating motor to the differential gear, and means for detecting of the direction of the movement of the bobbin rail for controlling the direction of the rotation of the reversible rotating motor so that the increased speed of the rotational movement of said predetermined fixed amount from the differential gear applied to the reciprocating means is obtained irrespective of the direction thereof.

12. A flyer frame comprising:

a drafting unit;

a plurality of bobbins;

a bobbin rail on which said bobbins are mounted;

means for rotating bobbins on the bobbin rail so as to take up a roving from the drafting unit on the respective bobbins;

a first source for generating a two directional rotating movement;

reciprocating mean receiving the rotational movement from the first source for obtaining a vertical reciprocating movement of the bobbin rail in accordance with the direction of the rotational movement to be applied for obtaining a usual speed of the reciprocating movement of the bobbin rail for obtaining a usual speed of the reciprocating movement of the bobbin rail for carrying out a shaping operation of the roving on the respective bobbins;

a second source for generating a two directional rotational movement which is independent from the first source;

a differential gear arranged between the first source and the second source, and the reciprocating means for obtaining a combined rotational movement from the first and second sources which is applied to the reciprocating means for obtaining an increased speed of the bobbin rail irrespective of the direction of the movement of the bobbin rail;

first detecting means for detecting a full bobbin state of the bobbins wherein a desired amount of roving has been taken up on the bobbin;

second detecting means for detecting a desired vertical position of the bobbin rail;

third detecting means for detection of the vertical position of the bobbin rail higher than the desired position;

operating means for operating the second source, upon the detection of the full bobbin state by the first detecting means, so that an increase speed of the reciprocating movement of the bobbin rail of a predetermined fixed amount is obtained in such a manner that a reduced rotational movement of the same direction as that by applied by the first source is obtained by the second source when it is determined that the bobbin rail is moved upwardly when it is detected that the bobbin rail is located below the desired position, or the bobbin rail moved downwardly when it is detected that the bobbin rail located above the desired position, and that an increased rotational movement as opposite the direction as that by applied by the first source is obtained by the second source when it is determined that the bobbin rail is moved upwardly when it is detected that the bobbin rail is located above the desired position, or the bobbin rail moved downwardly when it is detected that the bobbin rail located below the desired position, and;

means for stopping the flyer frame, upon the detection of the desired vertical position of the bobbin rail by the second detecting means.

* * * * *